US006513751B2

(12) United States Patent
Michel

(10) Patent No.: US 6,513,751 B2
(45) **Date of Patent: *Feb. 4, 2003**

(54) AIR DIFFERENTIAL CORE WINDING APPARATUS

(75) Inventor: John Michel, Randolph, NJ (US)

(73) Assignee: Convertech, Inc., Wharton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/817,985

(22) Filed: Mar. 27, 2001

(65) Prior Publication Data

US 2002/0047067 A1 Apr. 25, 2002

Related U.S. Application Data

(63) Continuation-in-part of application No. 09/692,086, filed on Oct. 19, 2000.

(51) Int. Cl.[7] ..... B65H 75/24

(52) U.S. Cl. ..... 242/571.1; 242/571.6; 242/576.1

(58) Field of Search ..... 242/571.1, 571.2, 242/571.6, 571.7, 576.1

(56) References Cited

U.S. PATENT DOCUMENTS

| | | | | | |
|---|---|---|---|---|---|
| 2,215,069 | A | | 9/1940 | Meisel | |
| 2,849,192 | A | | 8/1958 | Fairchild | |
| 3,006,152 | A | | 10/1961 | Rusche | |
| 3,048,345 | A | * | 8/1962 | Willard | 242/571.1 |
| 3,053,467 | A | | 9/1962 | Gidge | |
| 3,127,124 | A | | 3/1964 | Tidland et al. | |
| 3,310,252 | A | | 3/1967 | Ewing | |
| 3,391,878 | A | * | 7/1968 | Naccara | 242/571.1 |
| 4,026,488 | A | | 5/1977 | Hashimoto | |
| 4,220,291 | A | | 9/1980 | Papa | |
| 4,229,014 | A | * | 10/1980 | Crowe | 242/571.1 |
| 4,332,356 | A | | 6/1982 | Damour | |
| 4,334,652 | A | * | 6/1982 | Blackburn | 242/571.5 |
| 4,496,114 | A | * | 1/1985 | Kataoka | 242/571.7 |
| 4,767,077 | A | * | 8/1988 | Kataoka | 242/571.7 |
| 4,953,877 | A | | 9/1990 | Slachta et al. | |
| 5,451,010 | A | | 9/1995 | Heuser | |
| 5,797,559 | A | * | 8/1998 | Coffey | 242/527.6 |
| 6,065,715 | A | * | 5/2000 | Andersson | 242/571.1 |
| 6,079,662 | A | * | 6/2000 | Miller et al. | 242/571.2 |
| 6,202,955 | B1 | * | 3/2001 | Self | 242/530.3 |
| 6,267,318 | B1 | * | 7/2001 | Gensheimer | 242/530.3 |

* cited by examiner

*Primary Examiner*—William A. Rivera
(74) *Attorney, Agent, or Firm*—Carella, Byrne, Bain, Gilfillan, Cecchi et al.; John G. Gilfillan, III; William Squire

(57) ABSTRACT

A plurality of core mounting outer ring members are each rotationally slidably mounted on a corresponding inner ring member having cam surfaces in the outer surface. A rotating drive shaft has radial pistons and rotates the inner ring member by frictional engagement of the pistons displaced by an inflatable bladder. A plurality of strips in one embodiment are between the bladder and the pistons for providing increased torque on the inner ring member. The outer ring member has a first annular array of bores with core gripping balls resiliently urged radially outwardly to grip a core receiving a winding strip thereabout. A second array of bores in the outer member receive larger core gripping balls which freely displace in the bores. Ramp camming grooves are in the outer surface of the inner ring member, the larger gripping balls are engaged with the grooves and are forced into gripping engagement with the received core when the inner ring member is rotated. The spring loaded balls provide initial friction load between the core and outer ring members so that the ramp balls can operate to grip the core upon rotation of the inner ring member.

12 Claims, 3 Drawing Sheets

AIR DIFFERENTIAL CORE WINDING APPARATUS

This application is a continuation-in-part of application Ser. No. 09/692,086 filed Oct. 19, 2000, now U.S. Pat. No. 6,402,084.

This invention relates to winding apparatus for winding tapes, cords and so on onto cores mounted on a drive shaft.

CROSS REFERENCE TO RELATED APPLICATION

Of interest is commonly owned copending application Ser. No. 09/385,283 entitled Differential Winding Rate Core Winding Apparatus filed Aug. 30, 1999 in the name of Robert Peter Gensheimer, now U.S. Pat. No. 6,267,318.

An air differential shaft differs from other types of mandrels that are designed to lock a core to the mandrel to prevent rotational slip between the core and the mandrel. Rotational slip is provided between the core and the mandrel to allow the mandrel to rewind multiple rolls on a single shaft at the same time. In a lock core mandrel no rotational slip is present between the drive mechanism and the core. A plurality of cores are mounted on a common shaft, each core for forming a separate roll. If all of the cores mounted on a common shaft are not the same inner diameter due to caliper variations, the smaller diameter rolls lose tension. This is undesirable as all rolls need uniform tension to uniformly wind the tapes, cords etc. onto the cores.

If the tension is too low, the elongated members may be wound too loosely. If the tension gets too high, the elongated member may break. Either condition is not acceptable on a high speed mass production apparatus.

The slip mandrels fall into two broad categories, "direct friction" or "slip ring" type. In the direct friction type, the slipping "clutch face" is between the core and the outside diameter of the mandrel. The slip ring type has a separate ring where the slipping takes place between the ring and the mandrel.

The slip ring works by stacking them axially in an array on a hollow tube called a body. A series of holes are bored into the body that allow pistons in the holes to protrude against an inner ring having outer ramp channels receiving balls mounted radially in the slip ring. A bladder inside the body is expanded by air pressure to force the pistons into the inner ring. The slip ring is external the inner ring and the balls protrude radially outwardly therefrom. The pistons when forced against the inner ring produces friction with the inner ring. The rotating body rotates the pistons therewith which in turn, torque the inner ring rotating it. The rotating inner ring radially inclined ramp channels are intended to cause the balls to ride up the corresponding ramps. This ramping action displaces the balls radially outwardly into the hard paperboard core to grip it. This is intended to rotate the core.

However, this mechanism experiences problems. The balls initially are not sufficiently frictionally engaged with the core. When the pistons are activated not all of the balls engage their corresponding cores with uniform friction so that some cores may not rotate or rotate at different speeds than other cores. The slip rings and outer rings may rotate in unison so that the clutch action of the slip rings and balls is not activated. There must be relative rotation of the slip ring to the outer ring. The present inventor has discovered that the cause of this problem is that there is insufficient friction between the outer ring and core. Thus when the pistons engage the different the inner rings to rotate the inner rings, the outer rings will rotate with the inner rings and the clutch action does not operate. That is, when the outer ring rotates relative to the inner ring, the clutch balls ride up the ramp of the inner ring and grip the core. If there is no relative rotation the ramp action does not occur and the balls do not grip the core. This results in riot driving the various cores with a uniform torque, causing uneven winding on the different cores.

The problem of inconsistent slip ring tension is addressed in U.S. Pat. No. 5,451,010 which discloses friction elements that pivot outwardly to provide initial drag so that the core can be held by the piston action. This is relatively complex and costly. The friction elements protrude and do not facilitate core removal. The core needs to be rotated to remove it from the mandrel requiring additional work by an operator.

In U.S. Pat. No. 4,026,488 to Hashimoto, cylindrical winding cores are mounted on a plurality core holders and a plurality of friction collars are mounted alternately on a single hollow shaft under axial pressure. Each of the collars is allowed to be axially moved and constrained in rotation and each of the core holders has a radial expansible means which are radially expanded by an air pressure supplied to a hollow shaft to come into pressure engagement with the inner surfaces of the cylindrical winding cores on the core holders. Catch buttons are used with a leaf spring to return the catch button to its retracted position when pressure is lost. When pressure is applied to a pressure chamber, the leaf spring and expansible means cooperate to push the catch buttons outwardly to grip a core. The expansible means is a radially expansible elastic half tube and responsive to pneumatic pressure applied to a pressure chamber. Pressure is applied axially to couple the T-shaped collars for rotation which pressure is changed to change the magnitude of the axial pressure applied from a shaft end. This is a relatively complex and costly apparatus.

In U.S. Pat. No. 2,215,069, spindles are disclosed for rolls to be wound on cores with a uniform grip. Disclosed plugs may be thrust outwardly into engagement with a core by means of a pressurized air inflatable tube encircling an inner shell and bound thereto by bands. When the tube is inflated the plugs are pressed outwardly and apply a pressure against the core inner wall to provide a compact winding and uniform tension.

U.S. Pat. No. 2,849,192 to Fairchild discloses a core engaging shaft. Fluid pressure is applied to a diaphragm and bulge it outwardly to grip a core.

U.S. Pat. No. 3,006,152 to Rusche discloses a pile driving mandrel.

U.S. Pat. No. 3,053,467 to Gidge discloses an expansible shaft employing fluid pressure. Self retractable gripping elastomeric members are mounted along an inner face of an outer shell, each with a radially extending portion. The shell is rigid and perforated with radial passages each receiving a member radial portion. Pressure deforms the members radially outwardly in the passages and project beyond the shell to increase the overall diameter of the shell. An inner inflatable container forms an elongated chamber with the inner face of the shell. The container is inflated to distort the buttons and cause the buttons to extend from the shell.

U.S. Pats. Nos. 3,127,124, 4,220,291, 4,332,356, 4,953,877 and 6,079,662 disclose chucks and apparatus related to winding tape and similar products on cores. Many of the above patents relate generally to providing plugs which radially extend outwardly for gripping a core. The problem as recognized by the present inventor with these apparatuses is that while the plugs are intended to provide uniform tension on the strips, tapes and so on being wound by gripping the cores with the plugs, there is still present a problem of lack of uniform tension on the strips and so on in many instances. Such lack of uniform tension may result in breakage or loose windings as discussed above. Further, none of these patents address the slip ring problem employing ramp type inner rings coupled with pistons and balls as discussed above.

In a core winding apparatus according to the present invention, the combination comprises a drive shaft having a longitudinal axis. A plurality of pistons are mounted for radial displacement in the shaft in axial arrays along the shaft axis, the axial arrays being arranged about the shaft in an annular array. A core receiving ring is mounted about the shaft, the core for receiving elongated elements to be wound thereon. The pistons selectively rotationally drive the core mounted on the core receiving ring. An inflatable bladder is mounted radially inwardly within the drive shaft and a plurality of elongated strips are included, each strip being in the interface between an axial array of the pistons and the bladder for selectively outwardly displacing the pistons to cause selective driving of a core received on the core receiving ring upon inflation of the bladder.

In one aspect, the strips are flat sheets of steel arranged in an annular array about the bladder.

In a further aspect, a clutch mechanism is associated with the pistons and the core receiving ring for selectively driving the core mounted on the core receiving ring.

Preferably the clutch mechanism comprises cam means responsive to the outward displacement of the pistons for the selective gripping of the core mounted on the core receiving ring.

The cam means in one aspect comprise a plurality of core gripping elements radially displaceable in the core receiving ring and a cam ring engaged with the elements and the pistons, the cam ring for selective rotation by the pistons in response to inflation of the bladder for camming the elements against the received core.

IN THE DRAWING

Figures 1, 2, 2A, 3, 4:
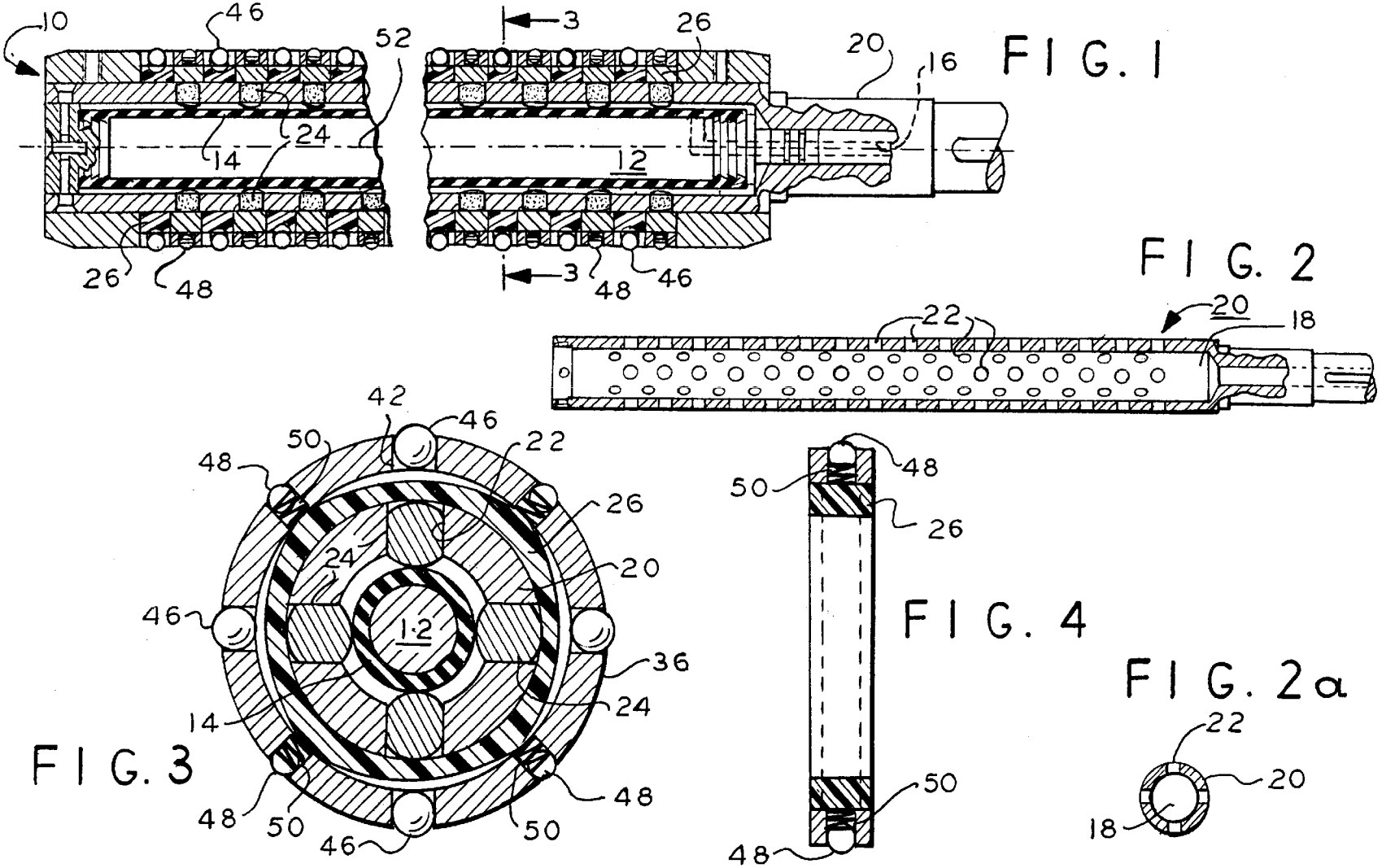
FIG. 1 is a fragmented sectional side elevation view through a drive shaft and core mounting ring assembly according to an embodiment of the present invention.
FIG. 2 is a sectional side elevation view through the drive shaft of the assembly of FIG. 1.
Figure 5:
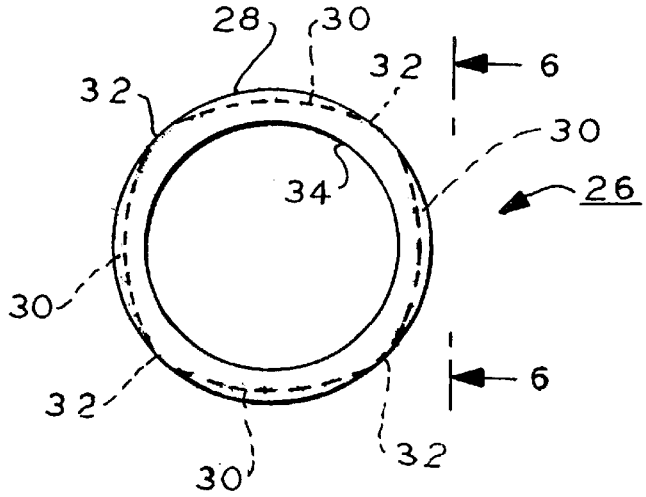
Figure 6:
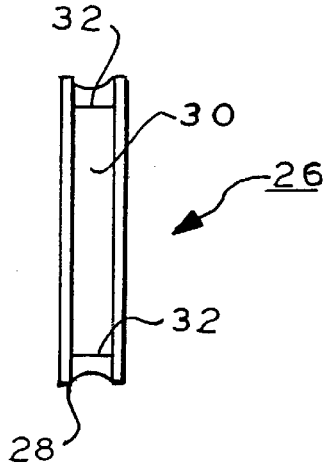
Figure 7:
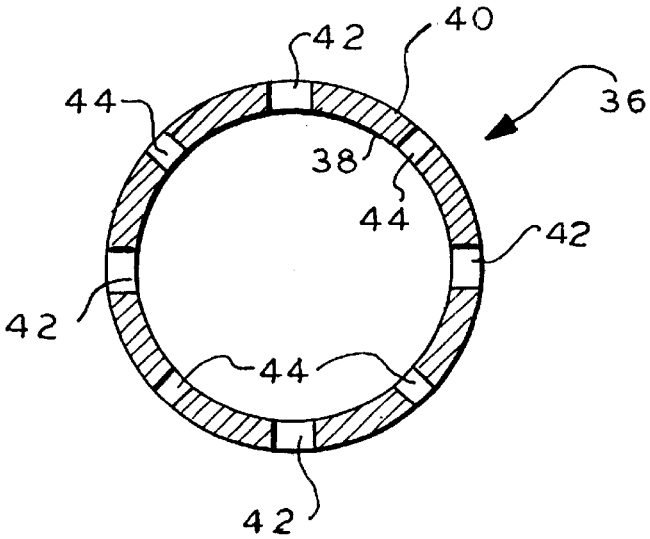
Figure 8:
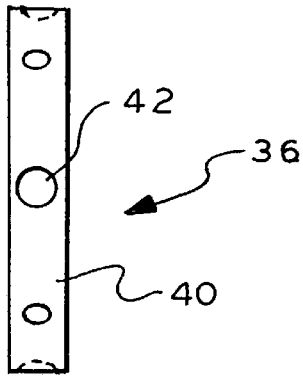

FIG. 2*a* is a sectional view through the shaft of FIG. 2;

FIG. 3 is a side elevation sectional view taken along lines 3—3 in FIG. 1;

FIG. 4 is a sectional elevation view of the outer and inner ring members of FIG. 3;

FIG. 5 is a side elevation view of the inner ring member of FIG. 3;

FIG. 6 is an end elevation view of the ring member of FIG. 5 taken along lines 6—6;

FIG. 7 is a side elevation sectional view of the outer ring member of FIG. 3;

FIG. 8 is an end elevation view of the outer ring member of FIG. 7.

Figure 9:
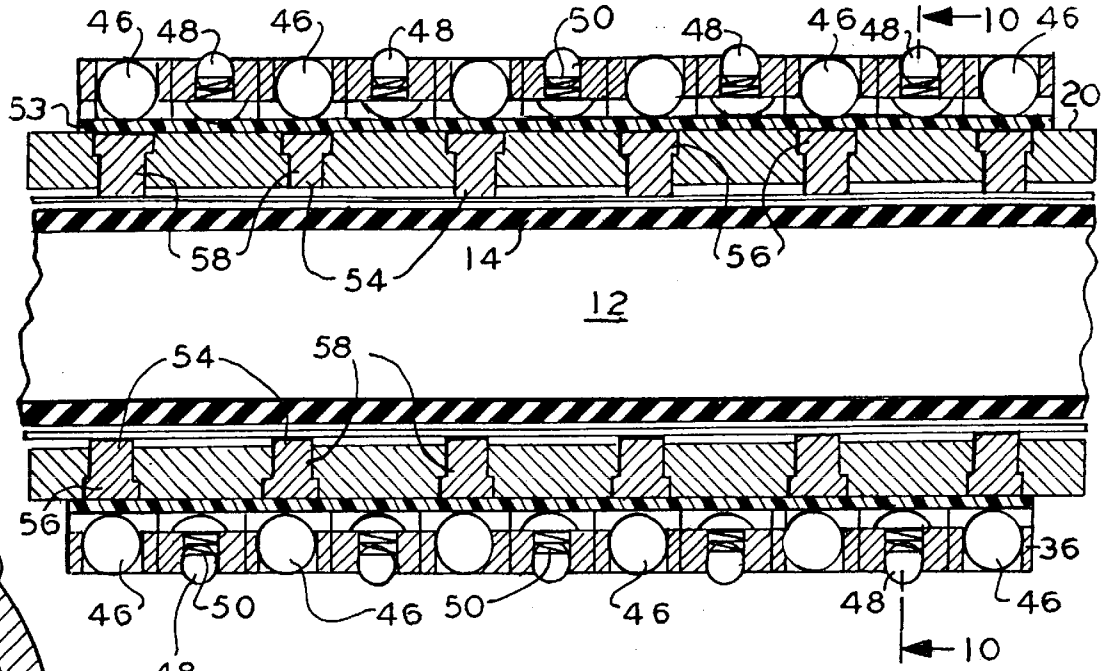
Figure 10:
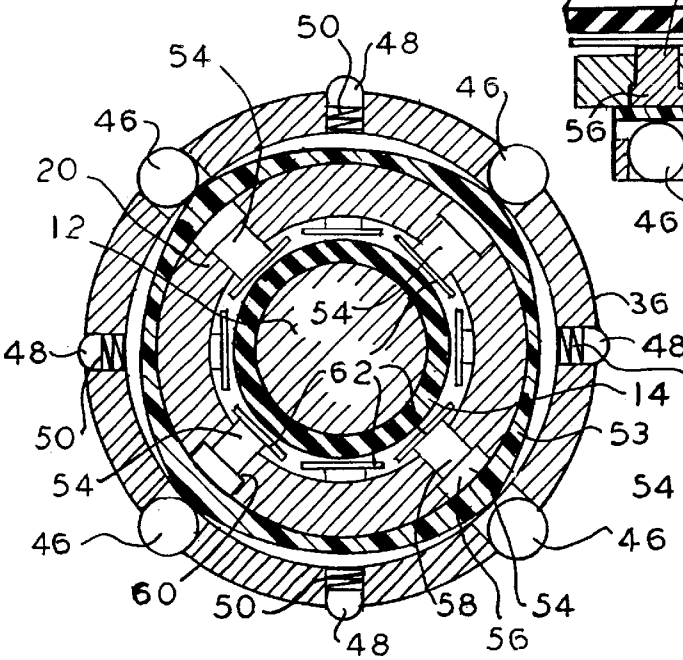

FIG. 9 is a fragmented sectional side elevation view through a drive shaft and core mounting ring assembly according to a second embodiment of the present invention; and FIG. 10 is a side elevation sectional view taken along lines 10—10 in FIG. 9.

In FIG. 1, assembly 10 in the present embodiment comprises an elongated steel circular cylindrical stem 12. Mounted about the stem 12 is an elongated inflatable rubber, elastomeric or other inflatable sheet material bladder 14. The bladder 14 is selectively inflated by pressurized air from a source (not shown) via inlet 16 in the stem 12. The bladder 14 and stem 12 are mounted within the axially extending bore 18 of drive shaft 20. The bladder and stem may be conventional.

The drive shaft 20, FIG. 2, is preferably steel and has a plurality of like radial through bores 22. The bores 22 comprise sets of four coplanar bores at right angles to each other. The bores of adjacent sets are oriented at 45° relative to the next adjacent set. A piston 24 is in each bore 22. The piston 24 extends through the bore and abuts the bladder 14 and is displaced when the bladder is inflated. The inflated bladder radially displaces the pistons outwardly so that the pistons protrude beyond the shaft 20. Normally the pistons are recessed within the shaft 20 at the piston radially outward surface as seen in FIGS. 1 and 3. The number and size of the pistons can be taylored for the particular desired torque characteristics for each implementation.

In FIG. 3, an inner ring 26 surrounds the shaft 20 and overlies pistons 24. In FIGS. 5 and 6, the inner ring 26, which is preferably molded thermoset plastic, and more preferably, phenolic, has an annular outer, surface 28. Four like semi-circular in transverse section grooves 30 are formed in the surface 28. Each pair of adjacent grooves 30 terminate at a ridge 32 at surface 28. The grooves each slope gradually radially and circumferentially outwardly in two opposing directions relative to the axis of the ring member 26. The inner ring member surface 34 is circular cylindrical. This surface serves as a bearing surface against which the pistons 24 abut when they are displaced radially outwardly. There is slippage between surface 34 and the pistons 24 which slippage controls the winding tension in response to controlling the bladder pressure. As the bladder pressure increases, the torque between surface 34 and the pistons 24 increases providing more drag on the inner ring 26, and, thus changing the tension on the wound strips during winding.

In FIGS. 3, 7 and 8, outer ring member 36 is preferably steel and has circular cylindrical inner surface 38 and outer surface 40. A plurality (four in this case) of like radial bores 42 of a first diameter are equally spaced about the ring. A second plurality of like bores 44, four also in this case, are spaced 45° from the bores 42. The bores 44 are a second diameter smaller than the diameter of bores 42 and generally about 30% smaller. The smaller diameter balls permits the balls to fit in the radial envelop of the outer ring with the springs and displace radially in the radial envelope of the outer ring.

The bores 42 correspond in number and spacing to the ramp surfaces 30 in the inner ring 26, FIG. 5. As a result each bore 42 is aligned simultaneously over a corresponding like position of the surfaces 30 with the outer ring member 36 mounted over the inner ring member 26 as shown in FIG. 3. Thus in one relative angular position, the bores 42 are aligned over the ridges 32 and in other angular positions are aligned over the same portion of the corresponding grooves 30.

A ball 46 mates with and is located in each of the bores 42. The balls 46 are slightly smaller than the bore diameters so that the balls freely can move in the bores. The end edges of the bores 46 are swaged somewhat to capture each ball 42 in that bore. The balls can protrude from the bores but can not freely leave the bores. The protrusion is shown for example in FIGS. 1 and 3.

A smaller diameter ball 48 mates with and is located in each of bores 44. These balls are also captured in their bores in similar fashion as balls 42 so that the balls 48 can also protrude radially outwardly from the bores 44 and yet will not fall out of these bores. A coiled metal compression spring 50 is in each bore. The spring 50 urges the corresponding ball 48 radially outwardly from the outer ring member 36 in the normal quiescent position of the ball 48. The compression force of the spring is determined according to a given implementation for frictionally gripping the mating core (not shown) to be received on the outer ring member 36. The outer ring member closely receives such cores on which elongated elements such as cord, tape and the like are to be wound. The cores are typically paperboard as known in this industry.

The larger balls 46 ride in the grooves 30 of the inner ring 26. In FIG. 3, the larger balls 46 are aligned over the midsection of the grooves 30 and thus normally would fall into the groove at the top of the ring due to the force of gravity. (The balls most uppermost in the figure toward the top of the figure are spaced above the groove 30 for purpose of illustration and normally would be abutting the ring member 26.) All of the small balls would normally be protruding as shown due to the force of the springs 50.

In operation, cores (not shown) for receiving tape strips, paper strips, cord or other elongated elements to be wound about the cores are mounted on the outer mounting ring members 36. The cores may be narrower or wider than the ring members 36, but may be of the same width in the axial direction of axis 52, FIG. 1. The cores are dimensioned to slide over and about the ring members 36 along the shaft axis 52. For example, there may be about a 0.030 inch clearance between the cores and the outer surface of the outer mounting ring member 36. In so mounting the cores, the cores correspond to one or more ring members 36 or portions thereof and are concentrically mounted thereon. The balls as spaced along and about the shaft accommodate cores of differing axial widths.

The balls 48 are radially compressed inwardly so as to resiliently grip the corresponding core(s) or core portion mounted thereabout. The balls 46 freely move in their bores and thus readily displace to the recessed position when a core is mounted on the outer ring member. The spring loaded balls 48 uniformly grip and abut the corresponding core providing a resilient preload on the core. The amount of initial gripping action when the core(s) is first mounted is in accordance with the spring characteristics of the springs 50.

When the shaft 20 commences rotation with a core(s) mounted on the outer ring member 36, the spring load of balls 48 provides an initial friction load between the outer ring member and the core. The rotation of the shaft rotates the pistons with it. The bladder is inflated to urge the pistons radially outwardly to frictionally abut the inner surface of the inner ring member 26.

The larger balls 46, which engage the cam ramp surfaces of the inner ring member, are intended to move along the ramp surface as the inner ring member rotates creating a clutch action. This requires relative movement of the inner ring to the outer ring. However, if the outer ring has low friction with the core, because of the various loading factors, the outer ring may slide within the core as the inner ring member rotates relative to the outer ring member. The inner ring does not always move sufficiently relative to the outer ring member and to the balls 46 to cause the larger balls 46 to sufficiently grip the core because of the low friction between the outer ring member and the core.

The present invention thus recognizes that additional friction is needed initially to insure that the outer ring will rotate the core by way of its friction grip to the initially stationary core (the core tends to stay stationary via the tension on the cord, tape etc. attached to the core) and not slip relative to the core at the beginning of the cycle. Thus without the spring loaded balls, there might be slippage of the core to the outer ring member and the clutch action of the larger balls will not commence. The inner ring member may never force the balls to fully grip the core in some cases.

The spring loaded balls 48, however, always induce a friction load between the core and outer ring member to over come the tension force on the elongated members to be wound about the core. Thus when the inner ring is rotated by the rotating pistons, the friction with the core induced by the spring loaded balls is such that the core will initially rotate with the inner ring member. This action causes the large balls to move up the respective ramps and clutch engage the core, firmly gripping the core.

The spring loaded balls in a stationary mode always press against the core to be wound. After winding, these spring loaded balls provide bearings for the core mounted thereon so the core can easily be removed from the outer ring. The larger balls become recessed into their bores and result in friction engagement of the core to the outer ring in the absence of the smaller balls. This friction interferes with the removal of the cores from the outer rings. The smaller spring loaded balls thus reduce the friction between the core and outer ring that might otherwise be present.

In FIGS. 9 and 10, a second embodiment of the present invention is disclosed. Parts with the same reference numerals as the parts in FIGS. 1–8 refer to identical parts. A description of these parts are not necessary for an understanding of the embodiment of FIGS. 9 and 10 as such description is given above. The inner ring 53 is shown thinner than the inner ring 26 of FIG. 3, but the ring is otherwise the same wherein the grooves 30 are the same as in the FIGS. 5 and 6 embodiment. Pistons 54 differ from pistons 24, FIG. 3. Pistons 54 have a circular cylindrical head 56 and a narrower shaft stem 58. The head 56 and stem 58 mate in a complementary T-shaped bore in the drive shaft 20 having a shoulder 60. In this way, the pistons 54 can radially retract toward the bladder 14 a maximum distance determined by the shoulder 60 in the piston bore against which the piston head 56 abuts. The radially outward surface of the piston head 56 abuts the inner ring 53 inner surface.

The piston 54 stems 58 abut steel flat strips 62. The strips 62 are relatively thin sheets of steel which extend along the longitudinal shaft axis concentric with the axis. The strips 62 abut the bladder 14. The strips 62 are arranged in a symmetrical array aligned with the pistons 54. Each strip 62 abuts all of the pistons 54 aligned in an axial array along the shaft 20 longitudinal axis. In this embodiment there are eight strips in an annular array about the bladder 14.

The strips 62 provide enhanced gripping of the inner ring by the pistons. This is because the bladder abuts the strips 62 over a significantly greater area than the abutment area in the embodiment of FIG. 3. This abutment of the bladder 14 over a greater area provides leveraged forces against the pistons which increases the value of the forces applied to the pistons for a given force on the bladder as compared to the force on the pistons of FIG. 3. In so increasing the forces on the pistons 53, the torque produced on the outer ring is greatly increased from the embodiment of FIG. 3. In addition, the size of the pistons 54 can be decreased for a given desired force. This decreased size also permits smaller diameter chucks formed by the assembly shown.

As is evident, the inner ring with the sloping surfaces forms a clutch mechanism with the balls 46. As the inner ring rotates relative to the outer ring the balls are forced radially outwardly forming a clutch which engages the received cores. The clutch exhibits slippage between the drive shaft and the gripping of the received core by the gripping balls in accordance with the principles described above. Inflation of the bladder controls the forces on the pistons and thus the friction engagement load of the pistons on the inner ring and thus the drive torque on the received core. While in the embodiment shown the inner ring is a camming member forming a clutch, it is evident that in other embodiments, such a camming member need not be used with the strips 62 which can provide enhanced loading directly on core gripping pistons or buttons as employed in prior art core winding shaft mechanisms employing inflatable bladders.

It will occur to one of ordinary skill in this art that various modifications may be made to the disclosed embodiment without departing from the spirit and scope of the invention. The disclosed embodiment is for illustration and not limitation. The invention is defined by the appended claims.

What is claimed is:

1. In a core winding apparatus, the core for receiving elongated elements to be wound thereon, the combination comprising:

a drive shaft having a longitudinal axis;

a plurality of pistons mounted for radial displacement in the shaft;

a core receiving ring mounted about the shaft, the core receiving ring having a plurality of radial bores;

the pistons for selectively rotationally driving the core mounted on the core receiving ring;

an inflatable bladder mounted radially inwardly within the drive shaft for selectively outwardly displacing the pistons to cause selective driving of a core received on the core receiving ring upon inflation of the bladder; and a clutch mechanism associated with the pistons and the core receiving ring comprising cam means responsive to the outward displacement of the pistons for the selective gripping and driving of the core mounted on the core receiving ring;

the cam means comprising a plurality of core gripping elements radially displaceable in the core receiving ring radial bores and a cam ring engaged with the core gripping elements and the pistons, the cam ring for selective rotation by the pistons in response to inflation of the bladder for camming the core gripping elements against the received core.

2. The combination of claim 1 wherein the pistons are arranged in axial arrays along the shaft axis, the axial arrays being arranged about the shaft in an annular array, further including a plurality of elongated strips, each strip being in the interface between an axial array of the pistons and the bladder for selectively outwardly displacing the pistons to cause selective driving of a core received on the core receiving ring upon inflation of the bladder.

3. The combination of claim 2 wherein the strips are flat sheets of steel arranged in an annular array about the bladder.

4. A core winding assembly comprising:

an outer ring member for releasably receiving a core thereon and having a plurality of annularly spaced first radial bores;

a core gripping member movable in each of the first radial bores and having a first position recessed in the corresponding first radial bore and a second position protruding radially outwardly from the corresponding first radial bore for gripping a core mounted thereon;

an inner ring member radially within the outer ring member, the inner ring member having an inner annular surface facing radially inwardly and an outer ramped annular surface facing the outer ring member extending about the axis and sloping radially outwardly for engagement with and displacing the core gripping member radially outwardly to the second position upon relative rotation of the inner ring member about the axis with respect to the outer ring member;

a drive shaft;

a plurality of pistons in the drive shaft radially aligned with the inner ring member and mounted for radially displacement in the drive shaft for selectively gripping and engaging the inner ring member inner annular surface and for rotationally driving the gripped inner ring member, the pistons being aligned in axial arrays along the longitudinal axis of the drive shaft and in an annular array about the drive shaft axis;

an elongated inflatable bladder mounted radially inwardly within the drive shaft; and an elongated strip in the interface between the bladder and each axial array of the pistons aligned along said axis, each said strips for urging the axially aligned pistons radially outwardly in response to inflation of the bladder into gripping engagement with the inner ring to rotationally drive the inner ring.

5. The assembly of claim 4 wherein the ramped annular surface comprises a groove semi-circular in transverse section, and the core gripping member is a ball received in the groove.

6. The assembly of claim 4 including a plurality of said ramped annular surfaces each extending about the ring member equal amounts to subtend equal chords.

7. The assembly of claim 4 wherein the core gripping member is a ball.

8. The assembly of claim 4 wherein the inner ring is molded thermoset plastic material.

9. The assembly of claim 4 wherein the first radial bores alternate circumferentially with second bores about the outer ring member, the second bores including core gripping members resiliently urged radially outwardly from the outer ring member.

10. The assembly of claim 4 further including a bladder support stem within said bladder, and means for supplying pressurized air to the bladder for expanding the bladder for displacing the pistons.

11. In combination:

an elongated circular cylindrical stem having an axis;

an elongated bladder mounted over the stem;

a plurality of elongated strips over the bladder arranged in an annular array about the bladder and extending in an axial direction along the axis;

input means for receiving pressurized air for selectively inflating the bladder;

a shaft mounted about the bladder and having a plurality of first radial bores;

a piston in each said first radial bores for radial outward displacement in the shaft, the pistons in engagement with said strips, the strips for urging the pistons radially outwardly in response to inflation of the bladder;

an inner ring with an inner surface facing said pistons for selective friction engagement with the pistons upon said outward piston displacement, the inner ring having a plurality of like outer ramp surfaces each sloping radially outwardly in the same general circumferential direction about the shaft forming a cam surface;

an outer ring with a plurality of second radial bores; and a core gripping element captured in and recessed in each of the second radial bores in a first position and protruding from the respective second radial bore in a second core gripping position, the core gripping element in engagement with the ramp surfaces for forming a clutch for selective rotatably driving the received core.

12. In a core winding apparatus, the core for receiving elongated elements to be wound thereon, the combination comprising:

a drive shaft having a longitudinal axis;

a plurality of pistons mounted for radial displacement relative to the drive shaft and coupled to the drive shaft for rotation in response to rotation of the drive shaft;

a core receiving ring mounted about the drive shaft, the core receiving ring having a plurality of radial bores;

an inflatable bladder mounted radially inwardly within the drive shaft for selectively radially outwardly displacing the pistons to cause selective driving of the core receiving ring and the core received on the core receiving ring upon inflation of the bladder; and a clutch mechanism associated with the pistons and the core receiving ring comprising cam means responsive to the radial outward displacement of the pistons for the selective gripping and driving of the core mounted on the core receiving ring;

the cam means comprising a plurality of core gripping elements radially displaceable in the core receiving ring radial bores and a cam ring engaged with the core gripping elements and with the pistons, the cam ring for selective rotation by the pistons in response to inflation of the bladder for camming the core gripping elements against the received core.

* * * * *